US006935286B2

(12) United States Patent
Mallebrein et al.

(10) Patent No.: US 6,935,286 B2
(45) Date of Patent: Aug. 30, 2005

(54) CONNECTION BETWEEN A STEM END ON A GAS EXCHANGE VALVE IN AN INTERNAL COMBUSTION ENGINE AND A SLEEVE-LIKE ACTUATOR BODY OF A VALVE ACTUATOR

(75) Inventors: Georg Mallebrein, Korntal-Münchingen (DE); Hermann Gaessler, Vaihingen (DE); Udo Diehl, Stuttgart (DE); Karsten Mischker, Leonberg (DE); Rainer Walter, Pleidelsheim (DE); Stefan Reimer, Markgroeningen (DE); Simon Kieser, Sachsenheim (DE); Andreas Baumann, Markgroeningen (DE); Bernd Rosenau, Tamm (DE); Juergen Ulm, Eberdingen (DE); Sevan Tatiyosyan, Sersheim (DE); Juergen Schiemann, Markgroeningen (DE); Christian Grosse, Kornwestheimh (DE); Volker Beuche, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 246 days.

(21) Appl. No.: 10/110,619

(22) PCT Filed: Jul. 20, 2001

(86) PCT No.: PCT/DE01/02763

§ 371 (c)(1),
(2), (4) Date: Jul. 7, 2002

(87) PCT Pub. No.: WO02/14656

PCT Pub. Date: Feb. 21, 2002

(65) Prior Publication Data

US 2003/0145811 A1 Aug. 7, 2003

(30) Foreign Application Priority Data

Aug. 17, 2000 (DE) ..... 100 40 115

(51) Int. Cl.[7] ..... F01L 9/02

(52) U.S. Cl. ..... 123/90.12; 123/90.45; 123/90.55

(58) Field of Search ..... 123/90.12, 90.13, 123/90.16, 90.1, 90.39, 90.44, 90.45, 90.48, 90.52, 90.55

(56) References Cited

U.S. PATENT DOCUMENTS

| | | | | |
|---|---|---|---|---|
| 2,444,083 A | | 6/1948 | Anderson et al. | |
| 2,595,775 A | * | 5/1952 | De Wrangell | 123/90.12 |
| 3,209,737 A | | 10/1965 | Takeo et al. | |
| 5,029,516 A | | 7/1991 | Erickson et al. | |
| 5,682,846 A | * | 11/1997 | Scharnweber | 123/90.12 |
| 5,829,396 A | | 11/1998 | Sturman et al. | |
| 6,178,935 B1 | * | 1/2001 | Diehl et al. | 123/90.12 |

FOREIGN PATENT DOCUMENTS

| | | |
|---|---|---|
| WO | WO 99 66177 | 12/1999 |

* cited by examiner

*Primary Examiner*—Thomas Denion
*Assistant Examiner*—Ching Chang
(74) *Attorney, Agent, or Firm*—Kenyon & Kenyon

(57) ABSTRACT

The present invention relates to a connection between a shaft end of a gas exchange valve of an internal combustion engine and a sleeve-shaped actuating element of a valve actuator, which is guided in an axially movable manner within a pressure region, which is able to be pressurized with a pressure medium, of the valve actuator and at least partially surrounds the shaft end. The present invention provides for the connection to be situated outside of the pressure region and in the region of an opening, which is formed on the side of the valve actuator away from the combustion chamber, and is, for example, coaxial to the shaft end.

8 Claims, 1 Drawing Sheet

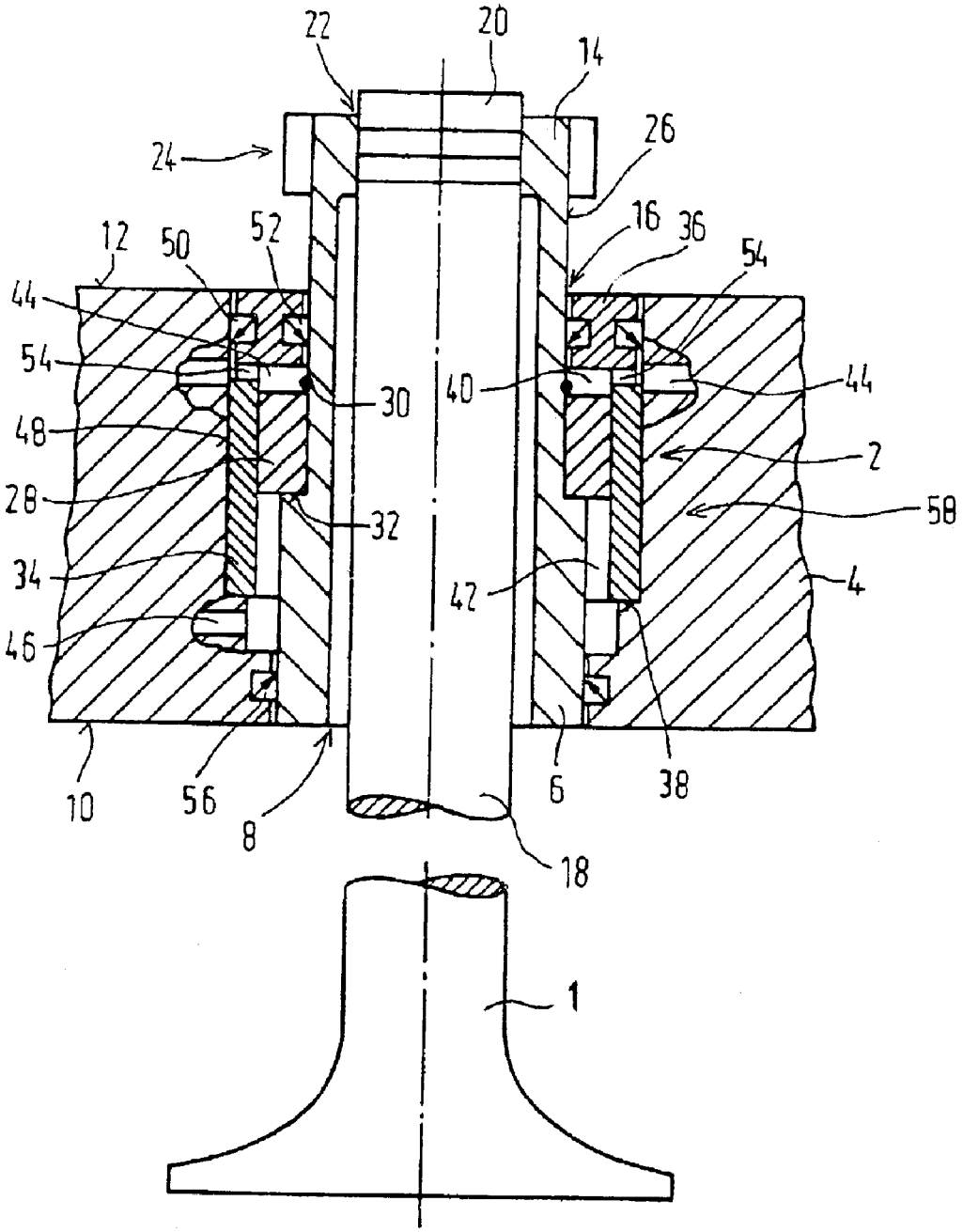
22
20
14
24
26
16
36
12
50
52
54
44
54
30
40
44
48
2
28
32
58
34
42
4
46
10
56
8
6
38
18
1

CONNECTION BETWEEN A STEM END ON A GAS EXCHANGE VALVE IN AN INTERNAL COMBUSTION ENGINE AND A SLEEVE-LIKE ACTUATOR BODY OF A VALVE ACTUATOR

FIELD OF THE INVENTION

The present invention relates to a connection between a shaft end of a gas exchange valve of an internal combustion engine and a sleeve-shaped actuating element of a valve actuator.

BACKGROUND INFORMATION

Such a connection is described in PCT Published Patent Application No. WO 99/66177, where the actuating element is formed by a differential piston that may be guided in an axially movable manner within a pressure region, able to be pressurized by a pressure medium, of a cylinder arranged in an actuator housing and surrounds the shaft ends of the gas exchange valve. The pressure region may include a top and a bottom working chamber within the cylinder, which may be axially spaced by the differential piston and may be bordered by its two end faces. Depending on the pressurization of the two working chambers, the differential piston may slide up and down within the cylinder. The connection of the shaft end of the gas exchange valve and the differential piston may be achieved by wedge pieces that are radially pressed against the shaft ends by a slipped-on conical tensioning sleeve having a complementary wedge angle and rest axially on the differential piston, thereby making it possible for annular protuberances formed on the radially internal peripheral surface of the wedge pieces to intermesh in a form-locking manner with annular grooves on the outer periphery of the shaft end.

The connection between the shaft ends of the gas exchange valve and the differential piston may be arranged completely within the hydraulically sealed cylinder in the top working chamber that is bordered at the extremity by a cylinder bottom that is one piece with the cylinder. The connection may, therefore, be first accessible from the outside when the hydraulically sealed cylinder or the entire actuator housing is first removed. In the course of periodical assembly or disassembly of the connection, e.g. for repair purposes, the hydraulic circuit may, therefore, need to be opened, and there may be a danger of dirt and air penetrating the hydraulic system. Moreover, seals may be damaged when the actuator housing is installed at a tilt with respect to the differential piston.

SUMMARY OF THE INVENTION

In contrast, an example connection of the present invention between a shaft end of a gas exchange valve of an internal combustion engine and a sleeve-shaped actuating element of a valve actuator may, due to its location in the region of the opening of the valve actuator, be easily accessible for assembly or disassembly purposes without the valve actuator having to be removed from the cylinder head. Since the example connection of the present invention may also be outside of the region of the valve actuator pressurized by a pressure medium, the hydraulic circuit may not need to be opened. In addition to optical monitoring of the connection, the accessibility to the moving end of the valve shaft may also render it possible to easily mount sensors, e.g. lift sensors, for experimental purposes.

Refinements and improvements of the present invention may be possible.

According to an example measure, the opening is formed at the end away from the combustion chamber of a through-hole extending through the valve actuator. The actuating element may include an actuator sleeve that is guided through the through-hole in an axially movable manner and may essentially extends from a bottom of the valve actuator into the region of the opening, a shaft of the gas exchange valve being inserted into the actuator sleeve from the bottom of the valve actuator that is surrounded by the actuator sleeve with, for example, little radial clearance. Consequently, the valve actuator may be placed on the cylinder head during assembly of the internal combustion engine, and at the same time, the shafts of the gas exchange valves may be inserted into the corresponding through-holes in the valve actuator. Since the connections between the gas exchange valves and the actuator sleeves may be arranged in the region of the openings and may, therefore, be easily accessible, they may be subsequently assembled in a simple manner from above.

The connection may be formed on an end segment of the actuator sleeve away from the combustion chamber, the end segment projecting out a bit from the opening of the valve actuator, and the shaft end of the gas exchange valve projecting into a coaxial bore hole formed in the end segment of the actuator sleeve away from the combustion chamber and being held there. As a result of the connection being arranged outside of the valve actuator, the connection may be even easier to access.

According to a further refinement, a ring-shaped cover may be provided in the region of the opening of the valve actuator to seal the pressure region with respect to the surroundings, the end segment of the actuator sleeve protruding through the cover. The cover may be arranged between a radially internal peripheral surface of the through-hole and a radially external peripheral surface of the actuator sleeve and may support a radially external sealing ring as well as a radially internal sealing ring.

BRIEF DESCRIPTION OF THE DRAWING

The FIGURE shows a lateral view of a cross section of an example embodiment of a connection of the present invention between a shaft end of a gas exchange valve of an internal combustion engine and a sleeve-shaped actuating element of a valve actuator.

DETAILED DESCRIPTION

For size purposes, only one gas exchange valve 1 of a valve mechanism of an internal combustion engine is shown in the FIGURE that is actuated by an actuating element 2 of a valve actuator 4 such that it performs upward and downward opening and closing movements.

The actuating element includes an actuator sleeve 6, which extends through a coaxial through-hole 8 of valve actuator 4 running between a bottom surface 10 near the cylinder head or near the combustion chamber and a top surface 12 of valve actuator 4 away from the combustion chamber, and projects with its free end segment 14 out a bit from an opening 16 away from the combustion chamber of through-hole 8. A shaft 18 of gas exchange valve 1 projects from a valve seat in the combustion chamber of the internal combustion engine through a cylinder head not shown for reasons of size into actuator sleeve 6, a shaft end 20 extending into a bore hole 22, which is coaxial to it, at end segment 14 of the actuator sleeve 6 away from the combustion chamber, and being retained there. Therefore, a connection 24 between actuator sleeve 6 and shaft end 20 of gas exchange valve 1 is achieved on the side of valve actuator 4 away from the combustion chamber in the region of extreme opening 16 of through-hole 8 and may be offset a bit from this opening 16 in the direction facing away from the combustion chamber. Connection 24 may have a form-locking and/or friction-locking design.

Actuating element 2 also includes a hydraulically operable differential piston 28, which is held on radially external peripheral surface 26 of actuator sleeve 6, is pushed from above onto actuator sleeve 6, and is axially secured to a shoulder 32 of actuator sleeve 6, e.g. by a retaining ring 30 resting on actuator sleeve 6 in an annular groove. Differential piston 28 is guided in a guide sleeve 34 in an axially movable manner, the guide sleeve being pressed from above against a shoulder 38 of through-hole 8 by a ring-shaped cover 36. Therefore, differential piston 28, actuator sleeve 6, and gas exchange valve 1 form a coupled unit that is guided in through-hole 8 of valve actuator 4 and more precisely in guide sleeve 34 in an axially movable manner.

The top end face of differential piston 28 away from the combustion chamber borders a top working chamber 40, and its bottom end face near the combustion chamber borders a bottom working chamber 42, both working chambers 40, 42 being sealed with respect to one another by differential piston 28 and being able to be filled with or emptied of a pressure medium, such as, for example, hydraulic fluid, via radially flowing pressure medium channels 44, 46. For this purpose, each pressure medium channel 44, 46 is able to be opened or closed in a manner not shown in greater detail via a control valve, e.g. a solenoid valve, as a function of the control signals of an electrical control unit.

Top working chamber 40 is bordered at the top in the direction of the surroundings by cover 36, which is inserted into opening 16 of through-hole 8 and is arranged between a radially internal peripheral surface 48 of through-hole 8 and radially external peripheral surface 26 of actuator sleeve 6. Cover 36 is attached, e.g. screwed on, in a manner not shown to valve actuator 4, and has on its radially external peripheral surface an annular groove extending in the circumferential direction in which a radially external sealing ring 50 is accommodated and on its radially internal peripheral surface another annular groove extending in the circumferential direction in which a radially internal sealing ring 52 is accommodated. Moreover, the bottom side of cover 36, which axially contacts guide sleeve 34 from above, has radial transverse bore holes 54 to create a connection between top pressure medium channels 44 and top working chamber 40.

Bottom working chamber 42 is sealed with respect to the cylinder head by a bottom sealing ring 56, which is accommodated in an annular groove formed on radially internal circumference 48 of through-hole 8 and is sealed against radially external peripheral surface 26 of the actuator sleeve. Top, radially internal sealing ring 52, which is supported by cover 36, and bottom sealing ring 56 are formed as dynamic seals, e.g. as lip seals, due to the axial movements of actuator sleeve 6 relatively to through-hole 8 and cover 36, while top, radially external ring seal 50 is only statically loaded and is formed by an O-ring, for example.

A region arranged within through-hole 8, between top cover 36 away from the combustion chamber and bottom sealing ring 56 near the combustion chamber and including top and bottom working chamber 40, 42 forms a hydraulic pressure region 58, which is able to be pressurized with pressure medium during operation. Therefore, connection 24 between shaft ends 20 of gas exchange valve 1 and actuator sleeve 6 is arranged outside of this hydraulically sealed pressure region 88 and, for example, a small distance away from opening 16 of through-hole 8 of valve actuator 4. Alternatively, connection 24 may also be arranged in opening 16 of through-hole 8 or offset a bit from the through-hole in the direction of the combustion chamber. The diameter of opening 16 may need to be large enough in this case for connection 24 to still be accessible from the outside. Top cover 36 may then need to be shifted in the direction of the combustion chamber so that connection 24 is still arranged outside of hydraulic pressure region 58.

Independently of the vertical position of connection 24 in relation to opening 16 of valve actuator 4, shaft 18 of gas exchange valve 1 protrudes from below, i.e., from the cylinder head, into actuator sleeve 6. Consequently, valve actuator 4 is placed on the cylinder head during assembly of the internal combustion engine, and at the same time, shafts 18 of gas exchange valves 1 may be inserted into valve sleeves 6 held in through-holes 8. Since according to the example embodiment the vertical height of valve actuator 4 may be so great that shaft ends 20 of gas exchange valves 1, which are in a closed position, protrude a bit from opening 16 of through-holes 8, and in the case of valve actuator 4 already being mounted on the cylinder head, connections 24 between the through-holes and corresponding end segments 14 of actuator sleeves 6, which also project from openings 16, may be assembled or disassembled from above in an easily accessible manner.

The functioning method of valve actuator 4 may then be as follows: bottom working chamber 42 is continuously pressurized by pressure medium via bottom pressure medium channel 46. When the pressure in top working chamber 40 is released, differential piston 28 is pushed upward together with actuator sleeve 6, thereby subsequently forcing gas exchange valve 1, which is connected to actuator sleeve 6, into a closed position. However, if top working chamber 40 is pressurized in a manner not more closely shown via two control valves, e.g. two solenoid valves, differential piston 28 moves downward in the direction of the combustion chamber due to the hydraulic working surface in top working chamber 40 that is greater than in bottom working chamber 42, thereby forcing gas exchange valve 1 into an open position.

What is claimed is:

1. A connection between a shaft end of a gas exchange valve of an internal combustion engine and a sleeve-shaped actuating element of a valve actuator including a pressure region and an opening, comprising:

a joining between the shaft end and the sleeve-shaped actuating element, the pressure region configured to be pressurized by a pressure medium, the sleeve-shaped actuating element configured to be guided in an axially movable manner within the pressure region, the sleeve-shaped actuating element further configured to at least partially surround the shaft end of the gas exchange valve, the joining being situated outside of the pressure region and in a region of the opening, and the joining being formed on a side of the valve actuator away from a combustion chamber;

a through-hole configured to extend through the valve actuator to the region of the opening, wherein the opening is formed on an end away from the combustion chamber;

wherein:

the sleeve-shaped actuating element includes an actuator sleeve arranged to be guided in an axially movable manner through the through-hole, the actuator sleeve essentially extending from a bottom of the valve actuator into the region of the opening, the gas exchange valve includes a shaft inserted into the actuator sleeve from the bottom of the valve actuator, the shaft being surrounded by the actuator sleeve, the actuator sleeve includes integrally an end segment away from the combustion chamber, the end segment projecting out a distance from the opening of the valve actuator, the end segment including a coaxial bore hole formed therein, and the shaft end of the gas exchange valve is arranged to protrude into the coaxial bore hole and is connected with the end segment of the actuator sleeve.

2. The connection according to claim 1, wherein the opening is coaxial to the shaft end.

3. The connection according to claim 1, wherein the shaft is surrounded by the actuator sleeve with a minimal radial clearance.

4. The connection according to claim 1, further comprising:

a ring-shaped cover arranged in the region of the opening for sealing the pressure region with respect to surroundings and through which the end segment of the actuator sleeve projects.

5. A connection between a shaft end of a gas exchange valve of an internal combustion engine and a sleeve-shaped actuating element of a valve actuator including a pressure region and an opening, comprising:

a joining between the shaft end and the sleeve-shaped actuating element, the pressure region configured to be pressurized by a pressure medium, the sleeve-shaped actuating element configured to be guided in an axially movable manner within the pressure region, the sleeve-shaped actuating element further configured to at least partially surround the shaft end of the gas exchange valve, the joining being situated outside of the pressure region and in a region of the opening, and the joining being formed on a side of the valve actuator away from a combustion chamber;

a through-hole configured to extend through the valve actuator to the region of the opening;

wherein:

the opening is formed on an end away from the combustion chamber;

the sleeve-shaped actuating element includes an actuator sleeve arranged to be guided in an axially movable manner through the through-hole, the actuator sleeve essentially extending from a bottom of the valve actuator into the region of the opening;

the gas exchange valve includes a shaft inserted into the actuator sleeve from the bottom of the valve actuator, the shaft being surrounded by the actuator sleeve;

the actuator sleeve includes an end segment away from the combustion chamber, the end segment projecting out a distance from the opening of the valve actuator, the end segment including a coaxial bore hole formed therein; and the shaft end of the gas exchange valve is arranged to protrude into the coaxial bore hole and is held there;

a ring-shaped cover arranged in the region of the opening for sealing the pressure region with respect to surroundings and through which the end segment of the actuator sleeve projects;

a radially external sealing ring; and a radially internal sealing ring, wherein the ring-shaped cover is radially arranged between a radially internal peripheral surface of the through-hole and a radially external peripheral surface of the actuator sleeve in order to support the radially external sealing ring and the radially internal sealing ring.

6. A connection between a shaft end of a gas exchange valve of an internal combustion engine and a sleeve-shaped actuating element of a valve actuator including a pressure region and an opening, comprising:

a joining between the shaft end and the sleeve-shared actuating element, the pressure region configured to be pressurized by a pressure medium, the sleeve-shaped actuating element configured to be guided in an axially movable manner within the pressure region, the sleeve-shaped actuating element further configured to at least partially surround the shaft end of the gas exchange valve, the joining being situated outside of the pressure region and in a region of the opening, and the joining being formed on a side of the valve actuator away from a combustion chamber;

a through-hole configured to extend through the valve actuator to the region of the opening, wherein:

the opening is formed on an end away from the combustion chamber;

the sleeve-shaped actuating element includes an actuator sleeve arranged to be guided in an axially movable manner through the through-hole, the actuator sleeve essentially extending from a bottom of the valve actuator into the region of the opening;

the gas exchange valve includes a shaft inserted into the actuator sleeve from the bottom of the valve actuator, the shaft being surrounded by the actuator sleeve;

the actuator sleeve includes an end segment away from the combustion chamber, the end segment projecting out a distance from the opening of the valve actuator, the end segment including a coaxial bore hole formed therein; and the shaft end of the gas exchange valve is arranged to protrude into the coaxial bore hole and is held there;

a ring-shaped cover arranged in the region of the opening for sealing the pressure region with respect to surroundings and through which the end segment of the actuator sleeve projects; and a guide sleeve fastened in the through-hole, wherein the sleeve-shaped actuating element includes a differential piston held on a radially external peripheral surface of the actuator sleeve and guided in an axially movable manner in the guide sleeve.

7. The connection according to claim 6, further comprising:

a top working chamber;

a bottom working chamber; and pressure medium channels formed in the valve actuator, wherein the differential piston includes an end face away from the combustion chamber that is arranged to border the top working chamber and an end face near the combustion chamber that is arranged to border the bottom working chamber, the top and bottom working chambers each configured to be one of filled with and emptied of the pressure medium via the pressure medium channels.

8. The connection according to claim 7, wherein:

if a pressure is applied to the bottom working chamber and another pressure in the top working chamber is simultaneously released, the differential piston is forced in a closed direction of the gas exchange valve, and if the pressure is applied to the top working chamber, the differential piston is forced in an open direction of the gas exchange valve.

* * * * *